US005207158A

United States Patent [19]

Fadner et al.

[11] Patent Number: 5,207,158

[45] Date of Patent: May 4, 1993

[54] LONG LIVED, VARIABLE-DELIVERY INK METERING METHOD, SYSTEM AND ROLLER FOR KEYLESS LITHOGRAPHY

[75] Inventors: Thomas A. Fadner; Lawrence J. Bain, both of La Grange, Ill.

[73] Assignee: Rockwell International, El Segundo, Calif.

[21] Appl. No.: 656,646

[22] Filed: Feb. 19, 1991

[51] Int. Cl.[5] ..... A41F 31/26

[52] U.S. Cl. ..... 101/348; 101/450.1; 101/483; 101/487; 29/895.32; 492/30; 492/59

[58] Field of Search ..... 101/348, 349, 350, 450.1, 101/451, 452, 483, 487; 29/121.1, 121.8, 132, 895, 895.3, 895.32, 895.33

[56] References Cited

U.S. PATENT DOCUMENTS 2,971,460 2/1961 Shindle ..... 101/487 X
4,793,041 12/1988 Jenkins et al. ..... 29/132 X
4,882,990 11/1989 Ijichi ..... 29/132 X
4,977,830 12/1990 Fadner ..... 101/350
5,033,380 7/1991 Sonobe et al. ..... 29/121.8 X

*Primary Examiner*—Clifford D. Crowder
*Attorney, Agent, or Firm*—C. B. Patti; V. L. Sewell; H. F. Hamann

[57] ABSTRACT

A roller 14 for use with a surface-scraping doctor blade to meter a fluid applied to an outer surface of the roller 14. The roller 14 has the following elements: a substantially cylindrical core 101 having a core surface; a coating 105 of a polymer material 102 on the core surface, the coating 105 having a predetermined thickness and having a predetermined percent by volume of substantially hard wear-resistant particles 103, the coating 105 also having a surface which is the outer surface of the roller 14; a plurality of cells 104 in the coating 105, each of the cells 104 having at least one cell wall oriented substantially perpendicular to the outer surface of the roller 14 and having an open end at the outer surface of the roller 14. A method for the manufacture of the roller 14 and a method for using the roller 14 are disclosed.

33 Claims, 9 Drawing Sheets

LONG LIVED, VARIABLE-DELIVERY INK METERING METHOD, SYSTEM AND ROLLER FOR KEYLESS LITHOGRAPHY

BACKGROUND OF THE INVENTION

In the art of keyless inking for lithographic printing processes whereby ink is metered into a printing press system by means of a metering roller and a cooperating scraping blade, Fadner in U.S. Pat. No. 4,601,202, Fadner and Hycner in U.S. Pat. No. 4,537,127 and Fadner in U.S. Pat. No. 4,603,634 have disclosed an advantageous method and means wherein the whole surface of a hard, wear-resistant metering roller for lithographic ink also possesses the dual property of being both hydrophobic and oleophilic, that is, water repelling and oil attracting. As clearly disclosed in Fadner, et. al., U.S. Pat. No. 4,690,055, one of the essential press components for operable keyless lithography is a metering roller having the aforementioned properties.

Hard ceramic materials such as chromium oxide, aluminum oxides and tungsten carbide are naturally high energy materials and correspondingly tend to be hydrophilic in the presence of water and tend to be oleophilic in the presence of oily materials. Metering rollers manufactured using these materials, while often used successfully in conjunction with either water based inks or with oil based inks in flexographic or letterpress printing respectively, fail to deliver consistent quantities of ink during lithographic printing wherein oil-based inks are used with water present. The extent of ink delivery inconsistency is determined by whether water present in the ink has displaced or debonded ink from the roller's ceramic surface As previously noted in U.S. Pat. No. 4,690,055, the extent of debonding depends in part upon the water content of the ink at any selected cross-press location, which water content in turn depends upon the format being printed.

The previously referred to U.S. Pat. No. 4,601,242 discloses one means for using the advantageously hard and wear-resistant ceramic property to obtain reasonably long lithographic ink metering roller lifetimes. Specifically, ceramic powder, and in particular alumina, is flame sprayed in a purposefully thin layer of less than 3 mils thickness over a copper-plated, celled, metering roller base. Copper is naturally hydrophobic and oleophilic. This procedure results in a hard, wear-resistant surface that has sufficient interparticle porosity relative to ink and water interactions so that the surface acts as if it was copper, thereby retaining ink in preference to water, yet simultaneously acting as a wear-resistant ceramic material relative to scraping blade wearing action. Although commercially viable, this type of roller may have a lifetime on a printing press of only about 20 to 30 million printing impressions because the ceramic layer must be kept relatively thin to assure that the hydrophobic property of the underlying copper is not negated by the hydrophilic characteristic of the ceramic layer. Further, the ceramic layer, which is naturally hydrophilic as well as oleophilic, may become increasingly or permanently hydrophilic due to an -accumulation of contaminants associated with use and cleaning of printing presses.

As disclosed in U.S. Pat. No. 4,977,830, hard ceramic coated rollers are known that can be treated to be beneficially contaminated, prior to or subsequent to the plasma spraying or laser engraving steps that produce the metering holes or cells in a ceramic coating, with oleophilizing essentially-organic compounds that more or less permanently render oleophilic and hydrophobic the somewhat porous, particulate ceramic surface of the resulting meter roller. This metering roller technology is useful in lithographic printing as long as the roller in fact remains oleophilic and hydrophobic as it is gradually worn due to the surface scraping action of the ink-doctoring blade. Two inherent drawbacks may limit this technology's useful lifetime on a press to, for instance, fifty million printed impressions or less.

One of these drawbacks is that laser engraving of high-melting-point ceramic materials leaves a hard recast layer of the ceramic material on the land areas surrounding each drilled hole. If this recast material is not completely removed, the ink delivery volume of the roller is somewhat unpredictable because the effective cell volume is greater than that predicted based on the nominal dimensions of the laser drilled holes or cells. The doctor blade rides on the recast mounds rather than on original surface land areas between the holes. Also, during printing these relatively rough or peaked recast material mounds act as force concentration centers to more rapidly wear out the co-acting doctor blade. Technology exists to remove all of the recast material by careful grinding. Accurately doing so involves the cost of an additional roller manufacturing step and requires removing at least some of the original ceramic coating to be certain of having removed all the recast material. This regrind approach can cause two problems relative to manufacture of hard ceramic rollers that for lithography need to be oleophilic and hydrophobic. One problem is that removal of the uppermost portions of the original surface-treated and therefore hydrophobic and oleophilic regions might destroy that essential dual surface property by inadvertent removal of the necessarily uppermost surface-treated roller portions. Secondly, surface grinding of hard materials such as ceramics involves the use of cutting fluid coolant/lubricants which may permanently adversely contaminate the metering roller upper surfaces destroying its hydrophobic and oleophilic properties.

The second inherent drawback of the laser-engraved approach to formation of metering cells when using ceramic or similarly hard, high-melting point materials is that the laser-drilled holes or cells are inherently conical in shape. Consequently, as the outermost surface portions of the roller are worn away during printing, even assuming a nominally smooth land area surface free of recast material was available initially, the cell volume decreases rather rapidly. Therefore, the amount of ink that can be delivered declines as the roller is worn. This negates consistent ink delivery volume over long time utilization of the roller on the press.

Mechanically engraved rollers are made by embossing well-defined patterns into a steel or aluminum pipe or cylinder roller core or base, then appropriately treating or overcoating with one or more thin layers of material to produce a chemically and mechanically resistant celled metering roller, as described in U.S. Pat. No. 4,862,799, for example. The nature of the continuous embossing process of a rotating curved cylinder surface requires that the walls of the cells be at a wide angle relative to the radial direction so that the embossing tool can enter and leave the cell as it is being created without fracturing the wall material. A typical cell geometry then is a truncated pyramid or similar configuration. All metering rollers manufactured by embossing engravature necessarily therefore have angular cell walls approximating the conical shape obtained with laser engraving of hard materials.

These inherent drawbacks of prior art metering roller technologies render difficult practical attempts to purposefully vary the amount of ink delivered by the celled metering roller, for instance by external application of modifying forces such as heat or pressure, to advantageously vary the printed optical density as required. If a metering roller could be manufactured that continued to deliver fixed amounts of ink over very long useful lifetimes on press despite its being gradually worn during that lifetime, it would be reasonable to consider using such independent means to vary ink delivery volume by controllably causing the ink input system to change from a known constant-delivery condition.

With flexographic or gravure keyless inking systems which use highly fluid inks, pigment content in the ink can readily be varied at press-side to accomplish the effect of delivering more or less coloration (pigment) to the substrate being printed. When using viscous oil-based lithographic inks, press-side alteration of the ink is generally not an acceptable alternative for practical operational reasons.

Changing to a metering roller having larger or smaller ink delivery capacity is another alternative for changing the ink input quantity and therefore the pigment delivery quantity, which therefore changes the printed optical density. This requires designing the press with quick-roller change capability as a criterion, often at the sacrifice of other machine or operational design options. Also, the metering rollers for large, high-speed presses are heavy, requiring mechanical lifting assistance devices. Such changes are generally not sufficiently rapid for use in high-speed, high volume printing operations. Means are needed to avoid these impractical means for modulation of keyless inking printed optical density values.

SUMMARY OF THE INVENTION

A principle object of the present invention is to provide a laser-engraved metering roller having a substantially improved useful lifetime as compared to prior art metering rollers.

Another object of the present invention is to provide a lithographic ink metering roller having a consistent, non-varying ink delivery volume throughout its useful lifetime under typical operating conditions despite gradual wearing away of the roller's surface.

A further object of the present invention is to provide metering roller means and method that prolongs the useful life of the co-acting doctor blade.

It is further objective of the present invention to provide a method and means for manufacture and use of an oleophilic and hydrophobic ink metering roller having essentially vertical cell walls rather than the conical or pyramidal shape cells typical of prior-art hard-material laser-engraved or mechanically-engraved metering rollers.

Yet another object of the present invention is to provide material and means for manufacture of an oleophilic and hydrophobic ink metering roller for engravature by a laser without producing recast material on the roller's surface.

Still another objective is to provide a low-cost, simple means for varying the volume of ink delivered by a celled ink metering roller manufactured according to the present invention without the necessity for ink formulation changes or press configuration changes or major press component changes.

The present invention is a roller for use with a surface-scraping doctor blade to meter a fluid applied to an outer surface of the roller. The roller has the following elements: a substantially cylindrical core having a core surface; a coating of a polymer material on the core surface, the coating having a predetermined thickness and having a predetermined percent by volume of substantially hard wear-resistant particles, the coating also having a surface which is the outer surface of the roller; a plurality of substantially cylindrical cells in the coating, each of the substantially cylindrical cells having a cell wall oriented substantially perpendicular to the outer surface of the roller and having an open end at the outer surface of the roller.

In advantageous developments of the present invention the predetermined thickness of the coating is substantially in the range of 5 to 50 mils. The predetermined percent by volume of substantially hard wear-resistant particles is substantially in the range of 10 to 60 percent. The hard wear-resistant particles have an average maximum dimension substantially in the range of 0.001 to 0.1 of the predetermined thickness of the coating. The polymer material forms a substantially continuous phase within the coating and the coating is oleophilic and hydrophobic, wherein the outer surface of the roller and the at least one wall of each of the cells are oleophilic and hydrophobic. The hard wear-resistant particles have sizes in the range of approximately 5 to 50 microns. The cells are cylindrical and have a diameter approximately in the range of 40.0 to 100.0 microns and a depth of approximately 5 to 50 microns. The coating has approximately 100 to 300 cells per inch.

The present invention also includes a method for manufacturing a roller for use with a surface-scraping doctor blade to meter a fluid applied to an outer surface of the roller. The method has the steps of: providing a substantially cylindrical core having a core surface; covering the core surface with a coating of a polymer material, the coating having a predetermined thickness and having a predetermined percent by volume of substantially hard wear-resistant particles, the coating also having a surface which is the outer surface of the roller; laser engraving a plurality of substantially cylindrical cells in the coating, each of the substantially cylindrical cells having a cell wall oriented substantially perpendicular to the outer surface of the roller and having an open end at the outer surface of the roller.

Furthermore, the present invention includes a method for metering a fluid from an outer surface of a roller with a surface-scraping doctor blade. The method has the steps of: providing the roller with a substantially cylindrical core having a core surface, with a coating of a polymer material on the core surface, the coating having a predetermined thickness and having a predetermined percent by volume of substantially hard wear-resistant particles, the coating also having a surface which is the outer surface of the roller and having a plurality of substantially cylindrical cells in the coating, each of the substantially perpendicular to the outer surface of the roller and having an open end at the outer surface of the roller; rotating the roller against the doctor blade, the doctor blade being held stationary; scraping the outer surface of the roller with the doctor blade so that a metered quantity- of fluid is provided in the cells; and wearing away the outer surface of the roller as the roller rotates and as the doctor blade scrapes against the outer surface with no substantial change in the amount of metered fluid provided as a result of the wearing away of the outer surface.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
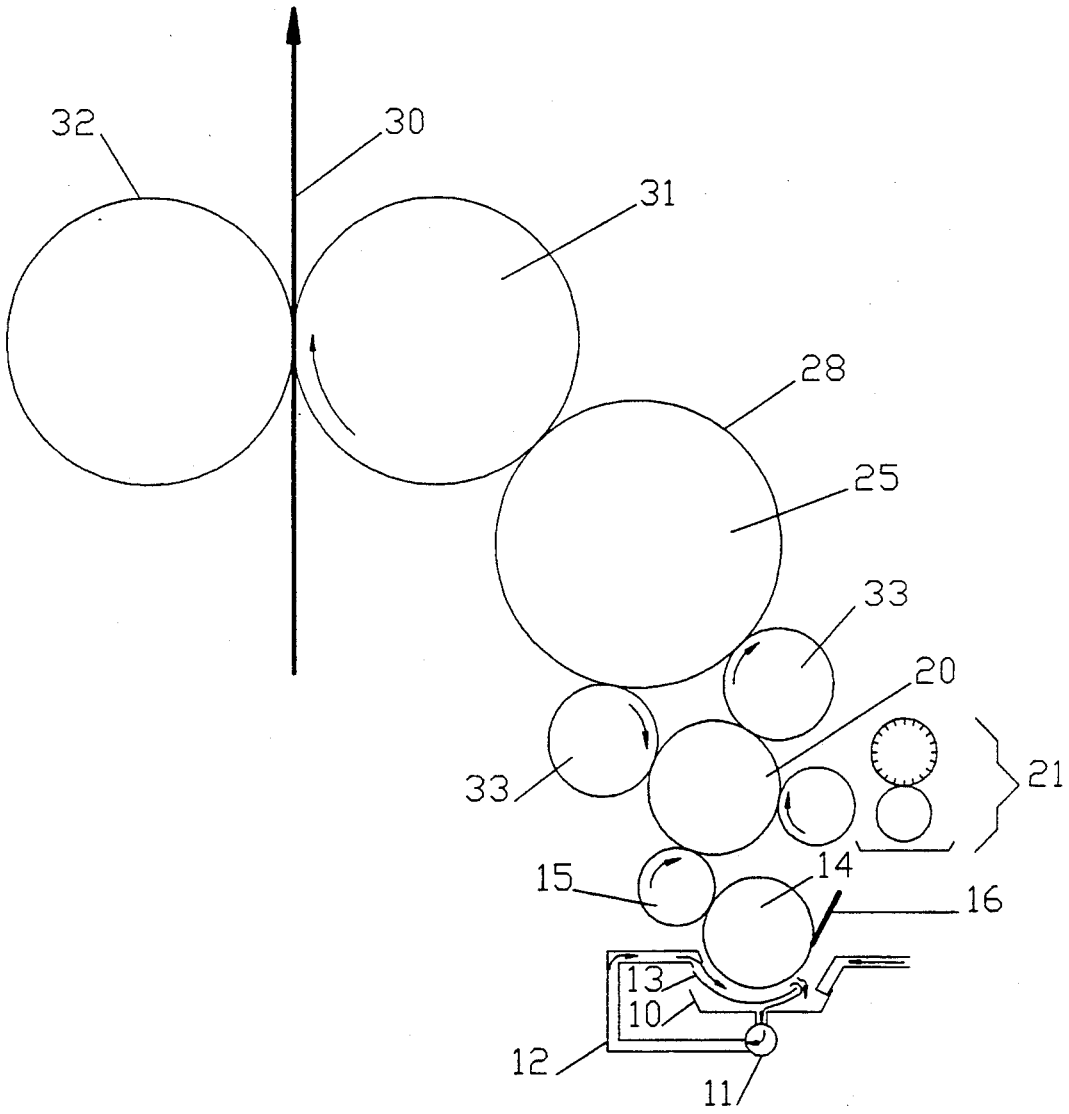
FIG. 1 is a schematic side elevation of a keyless lithographic printing system configuration illustrating one of the many useful arrangements of printing press rollers incorporating the ink metering roller of the present invention.

The present invention relates to an improved ink metering roller for use in modern, high-speed lithographic printing press systems, and to its advantageous use in inking systems wherein keyless means are provided to simplify the inking system and to simplify the degree of operator control or attention required during operation of the printing press.

Typically, as illustrated in FIGS. 1 through 4, a press using a keyless sinking system will comprise an ink reservoir or sump 10, 10A or 34, a circulating pump 11 and piping 12 interconnecting, for instance an ink pan 13, in proximity to which a metering roller 14 is located, to supply ink to a frictionally driven ink transfer roller or rollers 15 or form roller 33. A reverse angle scraping or metering blade 16 or excess ink removal means operates against metering roller 14 to remove substantially all of the ink on metering roller 14 except that in the cells.

Figure 2:
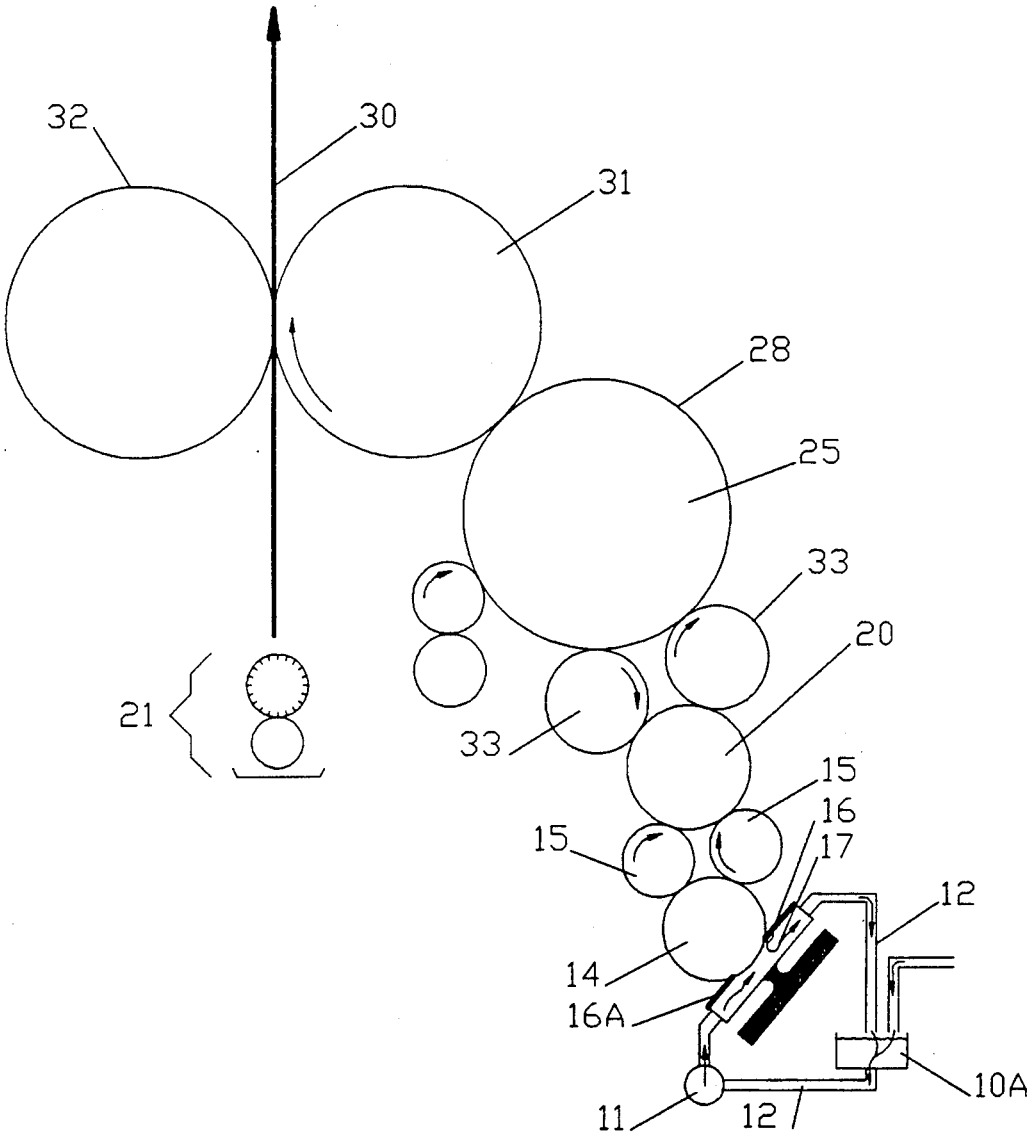
FIGS. 2, 3, and 4 are alternative press configurations similarly useful in the practice of the present invention.
Figure 3:
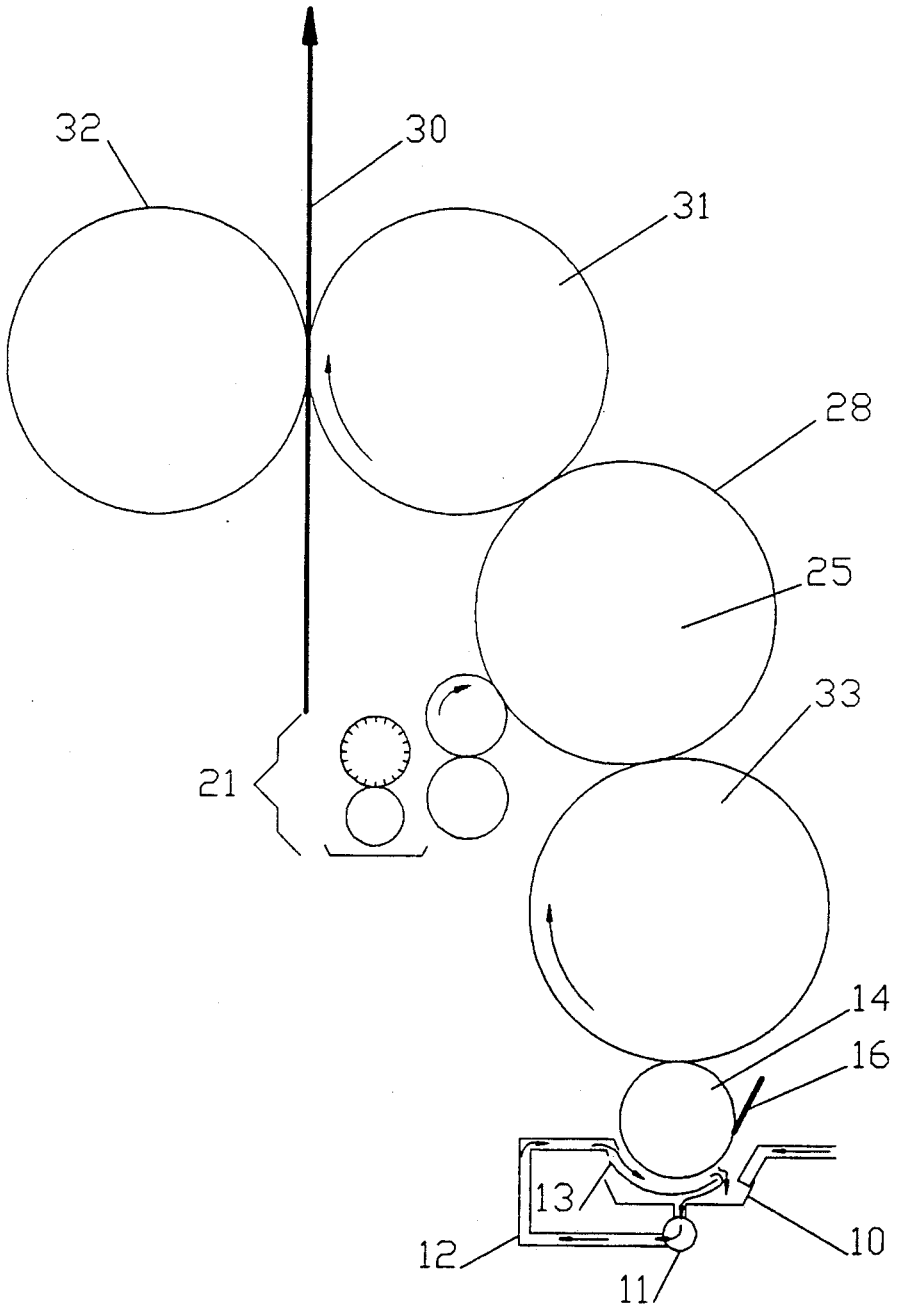

In FIG. 1 ink from transfer roller or rollers 15 is passed onto a substantially smooth inking drum 20 where it is combined with water supplied from dampener 21. Alternately ink from metering roller 14 is transferred directly to form roller 33 as in FIGS. 3 and 4. Dampening fluid can be supplied by any appropriate means, either to the inking drum 20 as shown in FIG. 1 or directly to the plate cylinder 25, as indicated in FIGS. 2 and 3. All of the aforesaid elements function to supply a uniform film of ink to the image areas and of water to the non-image areas of printing plate 28 mounted on press-driven plate cylinder 25. The plate on cylinder 25 in turn supplies ink in the form of an image to, for example, a paper web 30 being fed through the printing nip formed by the coacting blanket cylinder 31 and impression cylinder 32. All of the rollers in FIGS. 1 through 4 are configured substantially axially parallel.

In FIG. 2 an enclosed inking cavity 17 replaces elements 10 and 13 of FIG. 1 and a second or enclosing return-side blade 16A is employed as part of the cavity ink-input assembly 17. In this configurational type, an ink reservoir 10A can conveniently be located away from the press rollers, unlike the open pan ink input system of FIGS. 1 and 3 for which reservoir 10 must be located directly beneath metering roller 14 and blade 16. Additionally, FIG. 2 illustrates that two transfer rollers 15 working in cooperation with metering roller 14 may advantageously be employed to minimize ink transfer memory or starvation effects often seen when only one transfer roller is employed. FIG. 2 option also employs typical water-first conventional spiral-brush-input dampening 21 instead of ink-train dampening of FIG. 1.

FIG. 3 illustrates the use of a single plate-cylinder-dimensioned form roller 33 instead of two or more smaller form rollers 33 of FIGS. 1 and 2, which helps to reduce inker starvation and memory effects in the printed copy. Also depicted in FIG. 3 is a shorter inking train of rollers to further illustrate for purposes of this invention that a broad range of inking components together with the novel metering roller herein described may be used.

Figure 4:
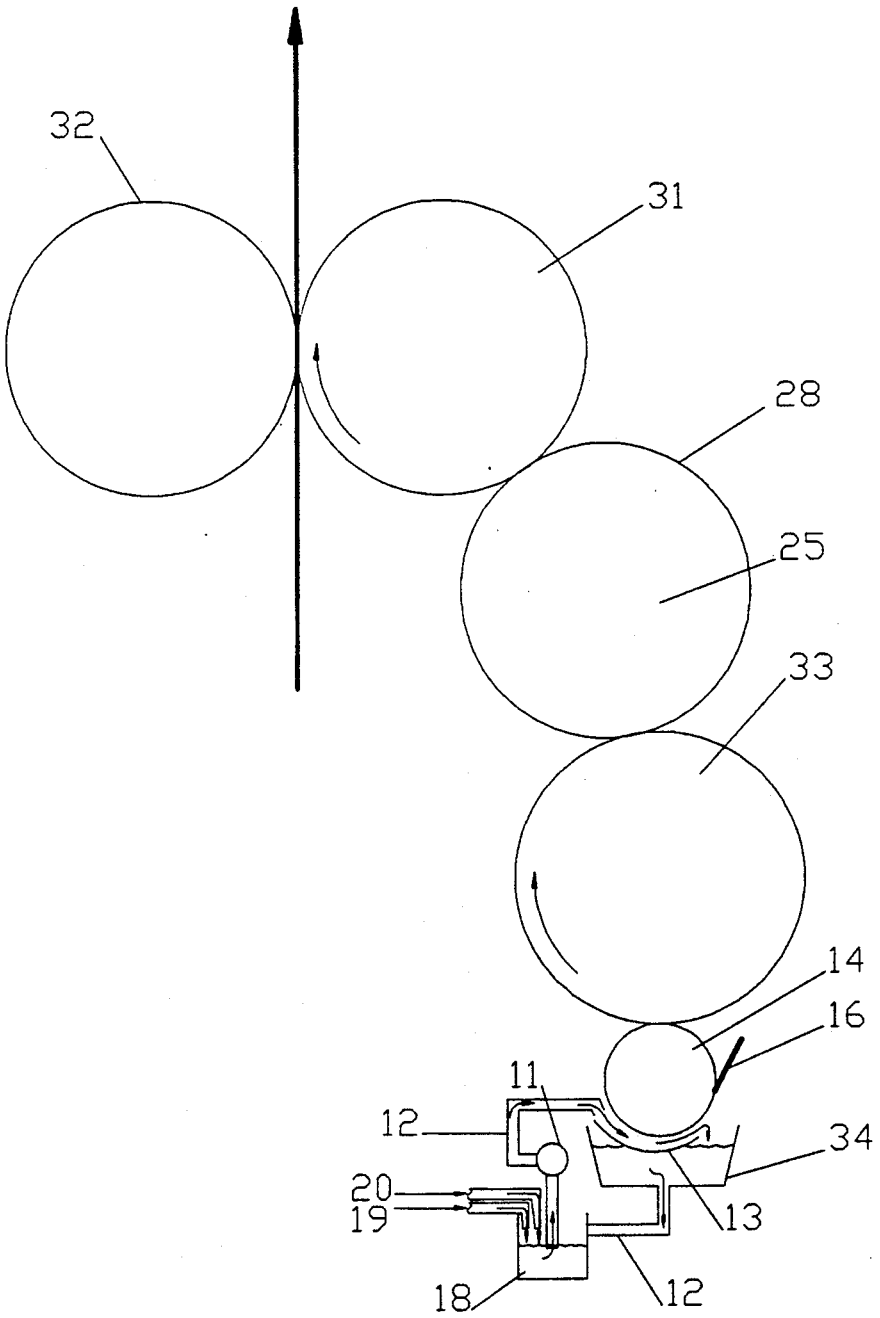

FIG. 4 depicts a FIG. 3 system adapted for single fluid lithography by using dampening water input 19 and fresh ink input 20 into a mixing tank 18 which continuously prepares a more-or-less homogeneous printing fluid mixture of the two materials for conveyance by means of ink system pump 11 and piping 12 to a keyless inking system similar to that depicted in FIG. 3. These single fluid elements have previously been disclosed in U.S. Pat. No. 4,864,925 (hereby incorporated by reference).

Many other press configurations can be visualized by those skilled in the art of conventional and of keyless lithographic printing. The primary features that are important for proper utilization of the present invention are set forth and discussed below.

The amount of ink reaching the printing plate is controlled by the dimensions of ink receiving cells in the surface of the ink metering roller disclosed herein and by the rheological properties of the ink as described herein, in conjunction with a coextensive scraping or doctor blade or other means that continuously removes virtually all of the ink from land or non-celled surface of the celled metering roller without removing ink carried in the cells.

Figure 5:
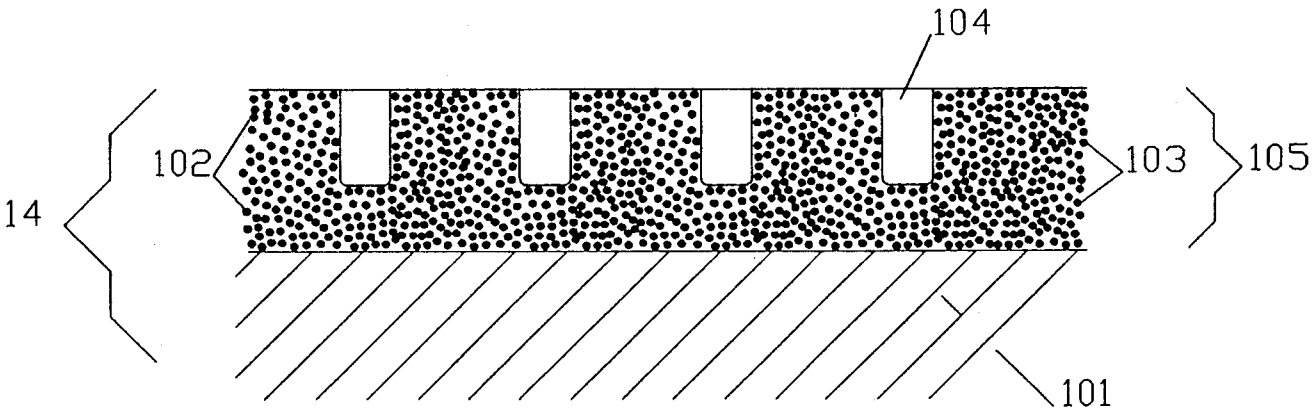
FIG. 5 is a cross-sectional drawing through a portion of a roller made according to the present invention, illustrating the laser-engraved surface coating region.
Figure 6:
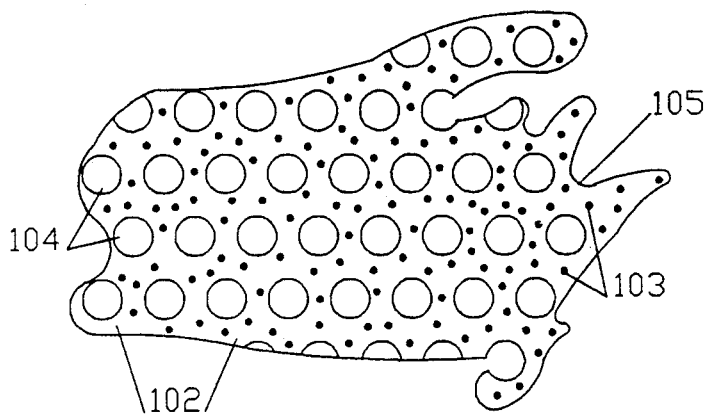
FIGS. 6 and 7 are enlarged top and oblique views that illustrate the near cylindrical shape of laser-drilled cells typical of metering rollers as disclosed herein.

The ink metering roller 14 of FIGS. 1, 2, 3 and 4, shown in expanded cross-section in FIG. 5 is the novel element and may be composed of a steel or aluminum or other core material 101 having dimensions and strength properties appropriate for the aforementioned printing press applications. The core material 101 is covered or coated with, for instance, a wearable chemically cross-linked organic polymer material 102 containing therein a substantial portion of hard particles 103. Laser engraving is advantageously used to form accurately dimensioned and positioned cells 104 in the cross-linked and therefore solidified, particle-filled polymeric coating layer 105 (see FIG. 6), which cells together with a scraping doctor blade serve to precisely meter to the rollers of a printing press, a known volume of ink. To help ensure continuous and similar metering of ink by all regions of the roller surface for the wear-related lifetime of the roller, the organic polymeric coating material forming the continuous phase or matrix 102 for holding particles 103 in place may be selected from organic materials that can be chemically cross-linked, for instance, by vulcanization to form an oleophilic and hydrophobic, insoluble and infusible coating layer 105.

An alternative organic polymeric material type for matrix 102 is the so-called engineered plastic type that can be applied to the core 101 as a heated molten viscous liquid admixture containing the required particulate phase and held in a mold or under other conditions such that when cooled a solid coated mass 105 having properties similar to that when using cross-linked polymeric materials is obtained.

Coating material layer 10 may be applied uncross-linked and molten, that is in a liquid state, to roller core 101 by any of several means whereby heat or pressure are used to force sufficient flow and therefore positioning of the coating material formulation as a layer onto core 101 prior to solidification of the formulation under chemical cross-linking conditions followed by cooling to ambient temperature or by programmed cooling of either type to ambient temperature. Once the cross-linking or solidification reaction is completed, the as-formed roller surface coating may be precision ground to the required concentricity and dimensional specifications.

Another alternative for applying the particulate-containing organic polymeric coating layer to a roller core would be by powder coating of mixtures of organic and hard-particle powders, followed by appropriate fusing and/or vulcanizing. Alternately the powder particles could conveniently be used as the hard particles previously coated or encapsulated with the appropriate fusible or crosslinkable polymeric material. Similarly, fluidized bed powder coating techniques could be employed followed by appropriate fusing, soildifying treatments.

All of these roller-coating procedures are well-known in the art of filled-coating-roller manufacture and processing. The roller is then ready for laser engraving according to the principles of the present invention.

The organic material 102 selected for the binder matrix of the roller coating 105 may be chemical cross-linkable to form an insoluble, infusible, solid or near-solid matrix that holds the hard-particulate water-resistance portion of the coating formulation in place under doctor-blade shearing conditions. The organic material may be selected from among a wide variety of reactive polymer, pre-polymer and monomer combinations. Suitable but no exhaustive examples are styrenes, butadienes, isoprenes, epoxy, neoprene, isobutylene prepolymers and oligomers of these, chemical modifications of these and the like which, by further suitable chemical modifications or treatment if necessary, undergo a cross-linking or solidification reaction step to form a hydrophobic and oleophilic material. Examples of materials not as suitable for the present invention because they form or tend to self-react into hydrophilic materials in the presence of water on press are polymers or cross-linked polymers made substantially of acrylic acid, methacrylic acid, easily hydrolyzed esters of acrylic or methacrylic acids, acrylonitrile, vinyl acetate and the like. However, a portion of the matrix 102 can be made of these potentially hydrophilic materials provided the resulting coating material 105 surface property is oleophilic and hydrophobic as hereinafter described.

Notwithstanding certain general or specific material disclosures of organic agents which can be reacted together to form oleophilic and hydrophobic matrix materials according to the practice of the present invention, the important criterion for the resulting roller's use as a lithographic inking roller can be more-or-less predicted and therefore selected by measuring the degree to which droplets of ink oil and of water will spontaneously spread out on the surface of the finished particulate-containing roller coating 105. The sessile drop technique as described in standard surface chemistry references is suitable for measuring this quality. Generally, oleophilic and hydrophobic roller materials have an ink oil (Flint Ink Co.) contact angle of nearly 0° and a distilled water contact angle of about 90° or higher and these values serve to define an oleophilic and hydrophobic material.

It has been found, for instance, that the following rules are constructive but not restrictive for selecting materials according to the principle:

| | |
|---|---|
| Acceptable | Water contact angle 90° or higher.<br>Ink Oil contact angle 10° or lower and spreading. |
| Possibly Acceptable | Water contact angle 80° or higher.<br>Ink Oil contact angle 10° or lower and spreading. |
| Probably Not Acceptable | Water contact angle less than about 80°.<br>Ink Oil contact angle greater than 10° and/or non-spreading. |

Coating material combinations that have this oleophilic and hydrophobic property as defined herein will in practice in a lithographic printing press configuration accept, retain and maintain lithographic ink on their surfaces in preference to water or dampening solution when both ink and water are presented to or forced onto that surface. It is this combined oleophilic and hydrophobic property that allows metering rollers use in a lithographic press inking roller train to provide transport of printing fluid with oil ink as the continuous phase from a reservoir to the substrate being printed without loss of printed-ink density control due to debonding of the ink printing fluid by water from one or more of the inking rollers.

The function of particulate material 103 in the coating layer 105 is to retard wearing away of oleophilic and hydrophobic organic matrix material 102 due to the doctor blade scraping action by rendering the whole coating structure modestly hard yet somewhat compliant or resilient on a small dimensional scale, unlike the flame-sprayed or plasma-sprayed ceramic coatings which are inherently very hard and brittle. The particulate material may be incorporated in amounts sufficient to generate this wear-resistant property without sacrificing the inherent oleophilic and hydrophobic dual property of the solidified organic matrix material by formulating so that the polymer portion is an essentially continuous phase in the coating. The particulate material may be selected from powders of alumina or other ceramics or from naturally occurring relative hard materials such as titanium dioxide, calcium carbonate, barytes, silica or clay, or from synthetic or chemically treated analogs or derivatives of these natural materials such as glass powder or hydrophobic clays. The preferred particle size range is from 5 to about 50 microns, recognizing that a manufactured or mined material might contain a portion of material outside this recommended range. Generally the presence of a large fraction of particles greater than about 50 microns will create more oddshaped cells than desired during laser engraving, since the laser engraved cell dimension at the surface is usefully in the range from about 10 to 100 microns, preferably 40 to 100 microns.

The particulate matter is included in the organic matrix coating formulation at from about 20% to 60% by volume of the finished coating, depending upon the quantity required to achieve optimal wear resistance. In this regard, it is perceived important that the organic, cross-linked or fused, polymeric matrix material exceeds the quantity required to completely surround each of the particles included in the nominal volume of the finished coating. In this manner an optimum combination of coating strength and wear resistance are achieved and a relatively uniform coated structure is obtained that will have consistent and uniform oleophilic and hydrophobic properties throughout its volume.

U.S. Pat. No. 4,882,990 (herein incorporated by reference), discloses the use of a coating composition for metering rollers for keyless lithographic printing that is in part similar to that disclosed herein except that the surfacesmoothed roller coating is employed directly to meter ink in conjunction with a doctoring blade without any step involving purposeful formation of cells in the roller's surface. This technology depends upon the presence of rather large-dimensioned particulate matter, for instance about 60 microns or greater in an average dimension. Under doctor blade scraping conditions, the roller tends to form more-or-less random interstices in its surface due to differential wear between the matrix and the large particle filler components and due to periodic loss of some of the essentially spherical hard particles. The resulting surface interstices apparently have volumetric dimensions and frequency in ranges similar to other prior art technologies where manufacturing methods such as mechanical or laser engraving are used to form welldefined cells in the surface. These rollers have demonstrated unusually high useful life-times on press, despite hardness values much below metallic or ceramic coated counterparts, one hundred million printing impressions not being uncommon.

It has been found difficult to controllably alter the amount of ink that can be delivered by a given roller manufactured with the materials according to U.S. Pat. No. 4,882,990 either by changing the dimensions of or the amount of hard particle incorporated into the coating. Even if means is found to do so, a roller change is required to effect ink delivery volume change and therefore the corresponding increase or decrease in optical density. Also, the actual ink volume delivery is highly dependent upon doctor blade angle and pressure against the roller, which factors are difficult to set uniformly across a 60" or wider press to purposefully change overall ink volume delivery. Application of add-on rollers or other devices to vary ink volume delivery complicates the inking system, which design direction is contrary to one of the perceived advantages of keyless inking, namely simplicity of construction and operation.

Contrary to prior art experience with laser engraved metering rollers, laser engraving of hard-particle-containing organic-polymer-matrix coatings as disclosed herein creates ink-receptive cells in the coating surface having known initial ink delivery capacity and results in cleanly drilled holes of predictable dimensions, in part because of the absence of detectable recast or redeposition of laser-evaporated coating material onto the land areas of the coating surface, which recast phenomenon is typical of laser-engraved ceramic or other substantially hard-material-only coatings. Thus the open end of the cells form substantially sharp corners where the cell wall meets the outer surface of the roll (FIG. 5, for example). This discovery is of particular significance because it allows manufacture of an oleophilic and hydrophobic metering roller having both known ink delivery capability and excellent press lifetime for the reasons herein explained.

Figure 7:
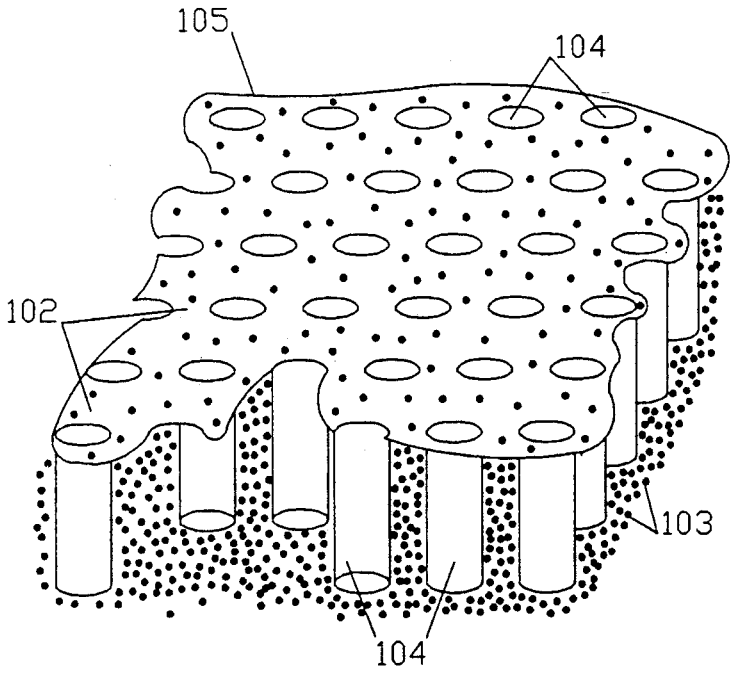

An equally important aspect of this discovery is that straight, deep, nearly radially-walled cells can be drilled into the coatings as illustrated in FIGS. 5 and 7 by lasers of usual and sufficient power. The walls have oleophilic and hydrophobic properties through the whole depth of the cells because of the uniform organic matrix material oleophilic and hydrophobic property as herein described. This property together with high wear resistance is unknown in the prior art engraved metering roller literature.

One advantage of the present invention is that the materials costs and coating application methods are generally less expensive than, for instance, specialty prior art metal plating operations or plasma-spray-coated ceramic coating operations. No finishing operation after laser-engraving is required due to the absence of the usual recast material. Therefore, the overall laser engraving operation is also less expensive.

Figure 8C:
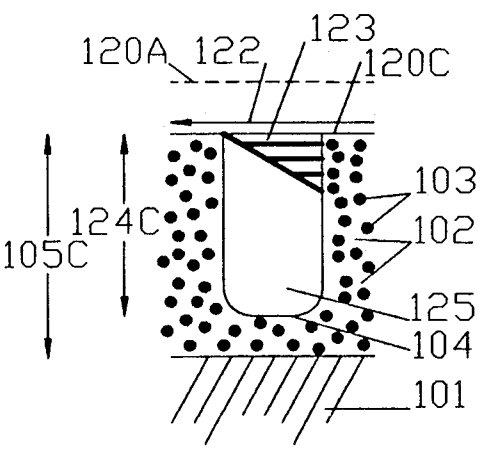
FIGS. 8A, 8B and 8C illustrate how portions of the deep cylindrical cells of the present invention are used to meter consistent quantities of ink as the roller surface is worn away.
Figure 8B:
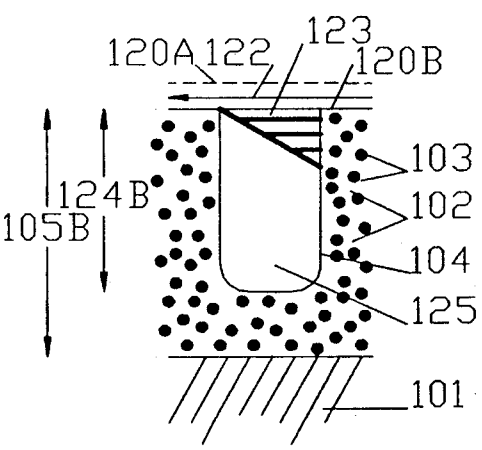
Figure 8A:
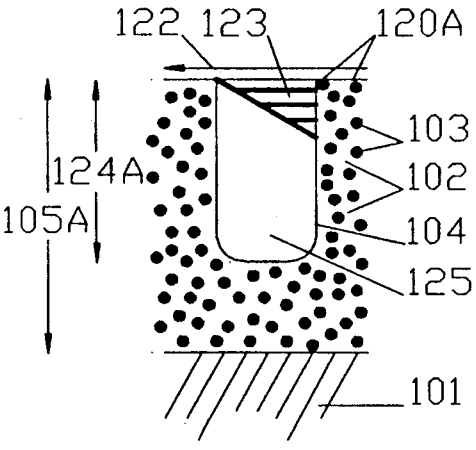

FIGS. 8A, 8B and 8C illustrate one of the major features of the technology of the present invention. Under given temperature and metering roller speed conditions and with a given ink formulation of some particular viscosity dependence on shear rate, the amount of ink that will flow out of each metering roller cell for transfer to the transfer roller at their confluence is related to the depth to which the surface applied shearing force 122 influences the ink in the cell to cause flow of the ink out of the cell. Of the total ink volume 125 in the cell, only the volume of ink 123 that has been subjected to sufficiently high shear will become sufficiently fluid to flow out of the cells in response to the adhesive force formed upon contact with the residual ink on the transfer roller and in so doing becomes replacement ink. This is depicted by the schematic shear force vectors and useful ink replacement volume 123 shown in FIG. 8A. Two important advantages are derived from this deep radial-walled essentially-cylindrical cell geometry because of this shear rate influence.

The first advantage is that the ink delivery volume 123 remains constant as long as the ink-filled cell depth 124A, 124B, 124C of FIGS. 8A, 8B, and 8C exceeds the indicated shear-influence region 123. Starting with cells that are deeper and can retain more ink than the amount that can in fact be delivered based on the shear force fluidizing effects as shown in FIG. 8A, correspondingly long roller lifetimes can be obtained because the ink delivery volume will not change with wear, as illustrated for the partially worn rollers of FIGS. 8B and 8C, wherein the outermost surface changes from 120A to 120B to 120C corresponding to roller coating thickness dimensional changes from 105A to 105B to 105C and to cell depth dimensional changes from 124A to 124B to 124C. This fixed-volume ink delivery capability is in sharp contrast with truncated pyramidal cells formed by mechanical engraving and with conical cells formed by laser engraving of hard materials. The ink delivery volume of all of these prior art types under similar running conditions decreases as the metering roller surface wears away.

A second major advantage derived from metering rollers with deep, straight wall cylindrical cell geometries is that combinations of relatively soft organic polymer and harder filler materials can be used that heretofore would not be considered. Unlike the technology disclosed in U.S. Pat. No. 4,882,990, ink delivery is independent of the coincident necessity for the doctor blade to wear away the roller surface. This prior art technology has wear-dependent ink delivery properties and therefore a limited range of materials that can be employed yet remain viable. In this present technology, since the ratio of cell volume to overall coating material volume remains relatively low, integrity and strength of the coating is nearly as high as that prior to the laser engraving operation. Consequently, and because rather deep holes or cells can be employed, combinations of materials that are purposefully sacrificial under doctor blade wearing conditions can be used which might not be considered viable if the roller coating needed instead to strongly resist the wearing effects of the doctor blade.

Another distinct advantage of the present invention is that simple means for varying the amount of ink that transfers from the cells may readily be applied. All lithographic inks are relatively viscous compared with the fluid inks used in gravure and flexographic printing. Since viscous inks rapidly decrease in resistance to flow, that is they decrease in viscosity, as temperature is increased, one can readily and controllably alter the amount of ink delivered to the inking roller train by the metering rollers of this invention simply by varying the temperature at or near the metering roller/transfer roller nip, thereby allowing more or less ink out the cells, depending upon whether the ink temperature has been increased or decreased.

Figures 9A, 9B, 9C:
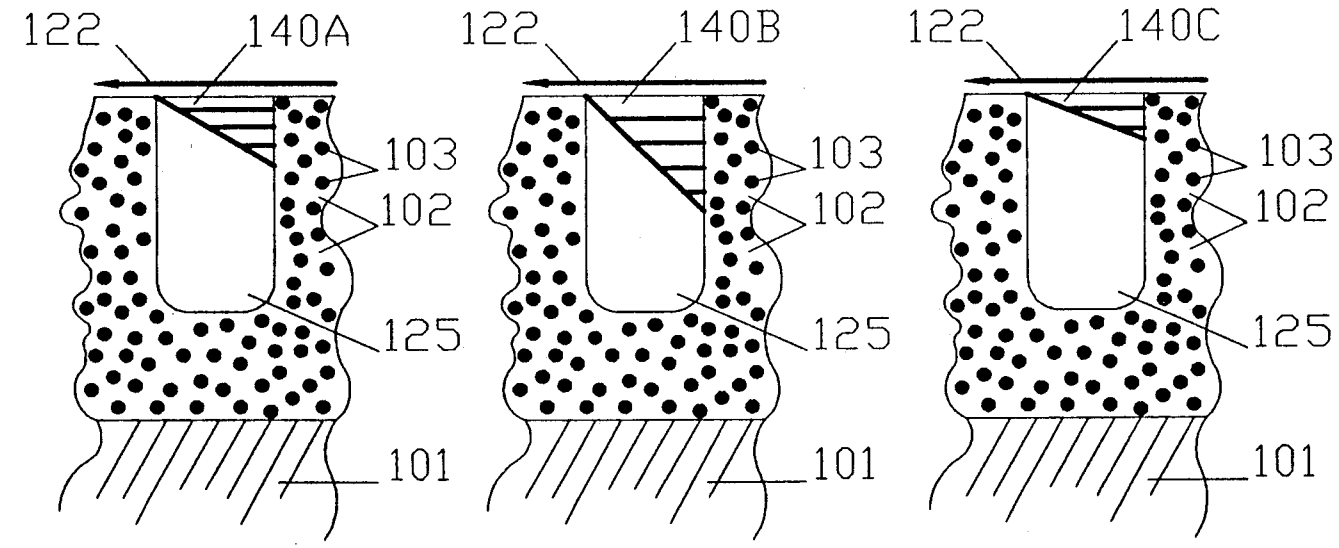
FIGS. 9A, 9B and 9C are diagrams illustrating how ink delivery from the rollers of the present invention may be purposefully varied depending upon the local temperature of the ink/roller combination.

This may be illustrated with reference to accompanying FIGS. 9A, 9B and 9C wherein a nominal ink operation temperature T, corresponding to FIG. 9A, volume of ink denoted by 140A will be transferable from the total cell ink volume 125 because of the shearing force 122 at the nip formed by contact of the transfer roller nip with the metering roller of this invention. As a result, copies will be printed by a press using this roller technology under this ink temperature condition that have a first optical density value. Increasing the temperature of the ink volume 125 in the ells will reduce the resistance to shearing forces of the ink at the cell openings resulting in more ink delivery 140B to the transfer roller as in FIG. 9B and a corresponding increase in printed optical density. Likewise, decreasing the ink temperature to below T will increase the inks's resistance flow and allow less ink 140C as in FIG. 9C to leave the cell than in the FIG. 9A case, resulting in lower printed optical density. In this manner the metering of ink by the roller of the present invention can controllably be modulated to purposefully vary the overall printed optical density without the necessity for replacing the metering roller and without having to change the ink formulation and without having to provide additional complicated roller systems, doctor blades and other mechanical devices that need continual maintenance and setting controls.

One simple way to control ink temperature is to heat or cool the input ink by means of a heat exchanger incorporated in the ink circulation pipes 12 or in the reservoir component 10 or 10A or 18 or 34 of FIGS. 1 through 4. Other state-of-the art cooling and heating techniques may be employed, such as controlling the temperature of the metering roller. Techniques for doing so are well-known in the art of printing.

It is recognized that changing the temperature of massive rollers and relatively large ink volumes is a slow process compared with today's high speed production of printed products. It is also known that scraping a metering roller in the presence of an oil-based lithographic ink may result in a significant gradual increase in ink temperature to eventual steady state values from about 100° F. to 150° F. depending upon heat transfer characteristics of materials in and near the blade/metering roller confluence. For these reasons, it is anticipated that the present invention's use of temperature to moderate ink input volume is most useful in an anticipatory sense. That is, if higher overall density is required at a second printing press site than at the first site, only the ink circulation system operating temperature needs to be changed and can be preset prior to the print run. Similar statements can be made for required print run to print run differences using the same printing press.

Figure 10:
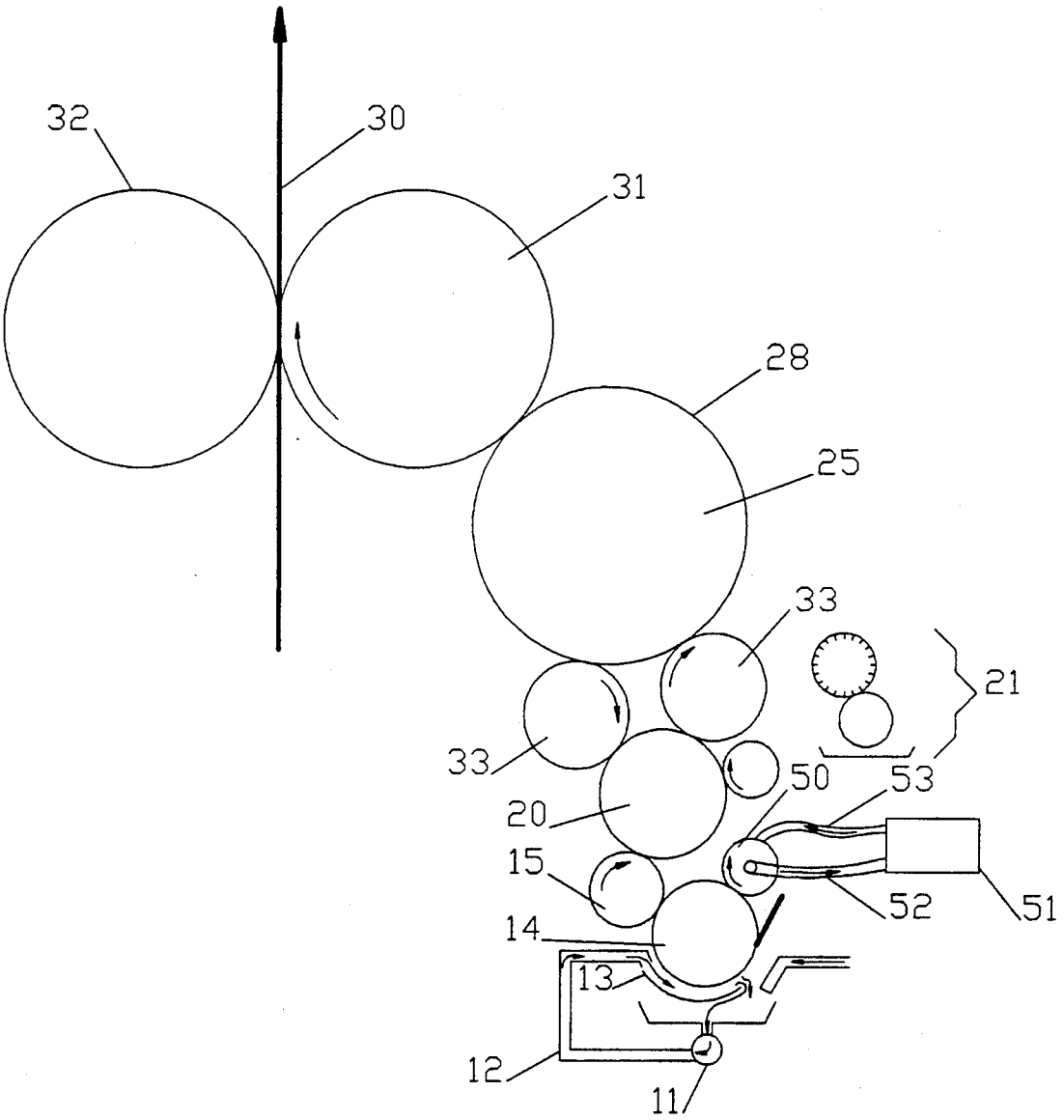
FIG. 10 is a schematic representation of one means for utilizing the metering roller of the present invention to change the amount of ink being input to the press by the metering roller, independent of the gradual wearing of the roller.

Another way to heat or cool the ink relative to transfer out of metering roller cells to the transfer roller or rollers is to provide a temperature regulated rider roller 50 in rotational sequence between the scraping blade 16 and the transfer roller 15, as for instance in the FIG. 10 variation of the FIG. 1 press roller illustration. Roller 50 can readily maintain a selected ink temperature of the thin ink film on the metering roller at the transfer roller nip by actually interchanging ink quantities because of the continual splitting of its ink film with the ink film that builds on roller 50 because of its oleophilic and hydrophobic surface. Roller 50 surface can be maintained at an appropriate temperature by means of known internal cooling/heating fluid or air circulation devices 51, 52, 53.

The invention is not limited to the particular details of the heating and cooling apparatus and method depicted and other modifications and applications are contemplated. Certain other changes may be made in the above described apparatus and method without departing from the true spirit and scope of the invention herein involved. It is intended, therefore, that the subject matter in the above depiction shall be interpreted as illustrative and not in a limiting sense.

What is claimed is:

1. A roller for use with a surface-scraping doctor blade to meter a fluid applied to an outer surface of the roller, comprising:

a substantially cylindrical core having a core surface;

a wearable coating of a polymer material on said core surface, said coating having a predetermined thickness and having a predetermined percent by volume of substantially hard wear-resistant particles, said coating also having a surface which is said outer surface of the roller;

a plurality of cells in said coating, each of said cells having at least one straight cell wall oriented substantially perpendicular to said outer surface of the roller and having an open end at said outer surface of the roller, said open end forming a substantially sharp corner where said cell wall meets said outer surface.

2. The roller according to claim 1, wherein said predetermined thickness of said coating is substantially in the range of 5 to 50 mils.

3. The roller according to claim 1, wherein said predetermined percent by volume of substantially hard wear-resistant particles is substantially in the range of 10 to 60 percent.

4. The roller according to claim 1, wherein said hard-wear resistant particles have an average maximum dimension substantially in the range of 0.001 to 0.1 of the predetermined thickness of the coating.

5. The roller according to claim 1, wherein said polymer material forms a substantially continuous phase within said coating.

6. The roller according to claim 1, wherein said coating is oleophilic and hydrophobic.

7. The roller according to claim 1, wherein said outer surface of said roller and said at least one wall of each of said cells are oleophilic and hydrophobic.

8. The roller according to claim 1, wherein said hard wear-resistant particles have sizes in the range of approximately 5 to 50 microns.

9. The roller according to claim 1, wherein said cells are substantially cylindrical and have a diameter approximately in the range of 10.0 to 100.0 microns and a depth approximately 5 to 50 microns.

10. The roller according to claim 1, wherein said coating has approximately 100 to 300 cells per inch.

11. A method for manufacturing a roller for use with a surface-scraping doctor blade to meter a fluid applied to an outer surface of the roller, comprising the steps of:

providing a substantially cylindrical core having a core surface;

covering said core surface with a wearable coating of a polymer material, said coating having a predetermined thickness and having a predetermined percent by volume of substantially hard wear-resistant particles, said coating also having a surface which is said outer surface of the roller;

laser engraving a plurality of substantially cylindrical cells in said coating, each of said substantially cylindrical cells having a straight cell wall oriented substantially perpendicular to said outer surface of the roller and having an open end at said outer surface of the roller, said open end forming a substantially sharp corner where said cell wall meets said outer surface.

12. The method according to claim 11, wherein said surface of said roller is machined to provide a smooth outer surface after said coating is applied to said core surface and before said laser engraving.

13. The method according to claim 11, wherein said predetermined thickness of said coating is substantially in the range of 5 to 50 mils.

14. The method according to claim 11, wherein said predetermined percent by volume of substantially hard wear-resistant particles is substantially in the range of 10 to 60 percent.

15. The method according to claim 11, wherein said hard wear-resistant particles have an average maximum dimension substantially in the range of 0.001 to 0.1 of the predetermined thickness of the coating.

16. The method according to claim 11, wherein the polymer material forms a substantially continuous phase within said coating.

17. The method according to claim 11, wherein said coating is oleophilic and hydrophobic.

18. The method according to claim 11, wherein said outer surface of said roller and said walls of said cells are oleophilic and hydrophobic.

19. The method according to claim 11, wherein said hard wear-resistant particles have sizes in the range of approximately 5 to 50 microns.

20. The method according to claim 11, wherein said cells have a diameter approximately in the range of 10.0 to 100.0 microns and a depth approximately in the range of 30.0 to 100.0 microns.

21. The method according to claim 11, wherein said coating has approximately 100 to 300 cells per inch.

22. A method for metering a fluid from an outer surface of a metering roller with a surface-scraping doctor blade, comprising the steps of:

providing the metering roller with a substantially cylindrical core having a core surface, with a wearable coating of a polymer material on said core surface, said coating having a predetermined thickness and having a predetermined percent by volume of substantially hard wear-resistant particles, said coating also having a surface which is said outer surface of the metering roller and having a plurality of cells in said coating, each of said cells having at least one straight cell wall oriented substantially perpendicular to said outer surface of the metering roller and having an open end at said outer surface of the roller, said open end forming a substantially sharp corner where said cell wall meets said outer surface;

rotating said metering roller against the doctor blade, the doctor blade being held stationary;

applying the fluid to the outer surface of the metering roller;

scraping said outer surface of the metering roller with the doctor blade so that a metered quantity of fluid is provided; and providing a substantially constant ink delivery volume from said metering roller to a transfer roller in contact with said metering roller as long as a depth of each of said cells is greater than a shear-influenced region of each of said cells;

wearing away said outer surface of the metering roller as the metering roller rotates and as the doctor blade scrapes against the outer surface with no substantially change in the amount of metered fluid provided as a result of the wearing away of the outer surface.

23. The method according to claim 22, wherein the temperature of the roller is varied in order to increase or decrease the quantity of metered fluid.

24. The method according to claim 22, wherein said outer surface of said roller is machined to provide a smooth outer surface after said coating is applied to said core surface and before said laser engraving.

25. The method according to claim 22, wherein said predetermined thickness of said coating is substantially in the range of 5 to 50 mils.

26. The method according to claim 22, wherein said predetermined percent by volume of substantially hard wear-resistant particles is substantially in the range of 10 to 60 percent.

27. The method according to claim 22, wherein said hard wear-resistant particles have an average maximum dimension substantially in the range of 0.001 to 0.1 of the predetermined thickness of the coating.

28. The method according to claim 22, wherein said polymer material forms a substantially continuous phase within said coating.

29. The method according to claim 22, wherein said coating is oleophilic and hydrophobic.

30. The method according to claim 22, wherein said outer surface of said roller and said walls of said cells are oleophilic and hydrophobic.

31. The method according to claim 22, wherein said hard wear-resistant particles have sizes in the range of approximately 5 to 50 microns.

32. The method according to claim 22, wherein said cells are cylindrical and have a diameter approximately in the range of 10 to 100 microns and a depth approximately in the range of 5 to 50 microns.

33. The method according to claim 22, wherein said coating has approximately 100 to 300 cells per inch.

* * * * *